US011329442B2

(12) United States Patent
Wright

(10) Patent No.: US 11,329,442 B2
(45) Date of Patent: May 10, 2022

(54) METHODS FOR INSTALLING ELECTRICAL CONTACTS INTO A CONNECTOR HOUSING

(71) Applicant: The Boeing Company, Chicago, IL (US)

(72) Inventor: David S. Wright, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 432 days.

(21) Appl. No.: 16/404,504

(22) Filed: May 6, 2019

(65) Prior Publication Data

US 2019/0260174 A1 Aug. 22, 2019

Related U.S. Application Data

(62) Division of application No. 14/824,220, filed on Aug. 12, 2015, now Pat. No. 10,355,439.

(51) Int. Cl.
*H01R 43/22* (2006.01)
*H01R 43/20* (2006.01)

(52) U.S. Cl.
CPC ..... *H01R 43/22* (2013.01); *H01R 43/20* (2013.01); *Y10T 29/53209* (2015.01)

(58) Field of Classification Search
CPC ... H01R 43/22; H01R 43/20; Y10T 29/53209; Y10T 29/532; Y10T 29/49002
USPC ..... 29/876, 874, 825, 592.1
See application file for complete search history.

(56) References Cited

U.S. PATENT DOCUMENTS 3,010,193 A 11/1961 Croall et al.
3,074,155 A 1/1963 Cootes et al.
3,871,057 A 3/1975 Moulin
3,967,356 A 7/1976 Holt
4,501,054 A 2/1985 Morgan
(Continued)

FOREIGN PATENT DOCUMENTS

EP 848462 6/1998
EP 1061617 12/2000

OTHER PUBLICATIONS

Office Action for Brazilian Patent Application No. BR102016013601-6 dated Jul. 3, 2020.

(Continued)

*Primary Examiner* — Peter Dungba Vo
*Assistant Examiner* — Azm A Parvez
(74) *Attorney, Agent, or Firm* — Kunzler Bean & Adamson

(57) ABSTRACT

An apparatus (100) for installing at least one electrical contact (152) into a connector housing (150) comprises a base (110) configured to fixedly support the connector housing (150), an alignment guide (122), extending from the base (110) and having a central axis (164), and a carrier (124), translatably and pivotally coupled with the alignment guide (122). With the connector housing (150) fixedly supported by the base (110), the alignment guide (122) is configured to be parallel to an insertion axis (160) of a socket (154) of the connector housing (150), and the carrier (124) is movable parallel to the insertion axis (160). The apparatus (100) additionally comprises a tool holder (132), coupled to the carrier (124). The tool holder (132) has a working axis (162), only one degree of freedom relative to the carrier (124), and only three degrees of freedom relative to the base (110).

20 Claims, 9 Drawing Sheets

(56) References Cited

U.S. PATENT DOCUMENTS

| | | | | |
|---|---|---|---|---|
| 4,750,261 | A | 6/1988 | Letsch et al. | |
| 5,177,846 | A | 1/1993 | Bryant | |
| 5,453,016 | A | 9/1995 | Clark et al. | |
| 5,504,989 | A | 4/1996 | Clark et al. | |
| 5,504,990 | A * | 4/1996 | Pittau | H01R 43/20 29/33 M |
| 5,655,294 | A | 8/1997 | Makino | |
| 2,666,869 | A1 | 7/2001 | Patrick et al. | |
| 9,300,104 | B1 | 3/2016 | Lazaro, Jr. et al. | |
| 2005/0060878 | A1 | 3/2005 | Hasircoglu et al. | |
| 2007/0011857 | A1 | 1/2007 | Francis et al. | |
| 2007/0286563 | A1 | 12/2007 | Wagner | |
| 2009/0064491 | A1 | 3/2009 | Furuya et al. | |
| 2011/0047788 | A1 | 3/2011 | Immekus et al. | |

OTHER PUBLICATIONS

Extended European Search Report for EP Patent Application No. 16183940.2 dated Nov. 29, 2016.
European Communication report for EP Patent Application No. 16183940.2 dated Feb. 12, 2019.
Extended European Search Report for EP Patent Application No. 19216998.5 dated Mar. 16, 2020.

* cited by examiner

METHODS FOR INSTALLING ELECTRICAL CONTACTS INTO A CONNECTOR HOUSING

BACKGROUND

Installing electrical contacts into a connector housing is time consuming, difficult to perform properly, and tiring for the operator. More specifically, it may be difficult to properly position an electrical contact relative to a socket of the connector housing and maintain the electrical contact in coaxial alignment with the socket of the connector housing while the electrical contact is biased into the socket. Additionally, the operator must not under-advance or over-advance an insertion tool into the socket when biasing an electrical contact into a socket of a connector housing, which is difficult to achieve with conventional electrical contact insertion tools and methods.

SUMMARY

Accordingly, apparatuses and methods, intended to address at least the above-identified concerns, would find utility.

The following is a non-exhaustive list of examples, which may or may not be claimed, of the subject matter according the present disclosure.

One example of the present disclosure relates to an apparatus for installing at least one electrical contact into a connector housing. The apparatus comprises a base configured to fixedly support the connector housing. Additionally, the apparatus comprises an alignment guide extending from the base and having a central axis. With the connector housing fixedly supported by the base, the alignment guide is configured to be parallel to an insertion axis of a socket of the connector housing. The apparatus also comprises a carrier translatably and pivotally coupled with the alignment guide. With the connector housing fixedly supported by the base, the carrier is movable parallel to the insertion axis of the socket of the connector housing. The apparatus further comprises a tool holder coupled to the carrier. The tool holder has a working axis, only one degree of freedom relative to the carrier, and only three degrees of freedom relative to the base.

Another example of the present disclosure relates to a system for installing at least one electrical contact into a connector housing. The system comprises a base configured to fixedly support the connector housing. Additionally, the system comprises an alignment guide extending from the base and having a central axis. With the connector housing fixedly supported by the base, the alignment guide is configured to be parallel to an insertion axis of a socket of the connector housing. The system also comprises a carrier translatably and pivotally coupled with the alignment guide. With the connector housing fixedly supported by the base, the carrier is movable parallel to the insertion axis of the socket of the connector housing. The system further comprises a tool holder coupled to the carrier. The tool holder has a working axis, only one degree of freedom relative to the carrier, and only three degrees of freedom relative to the base. The system also comprises an insertion tool coupled to the tool holder.

Yet another example of the present disclosure relates to a method of installing an electrical contact into a socket of a connector housing. The method comprises spatially fixing the connector housing relative to a base. Additionally, the method comprises coupling an insertion tool to the base with three degrees of freedom. The method also comprises partially installing the electrical contact into the socket of the connector housing or detachably coupling the electrical contact to the insertion tool. Further, the method comprises retracting the insertion tool away from the connector housing along an insertion axis of the socket. The method additionally comprises aligning the insertion tool with the socket of the connector housing. Also, the method comprises advancing the insertion tool into the socket of the connector housing along the insertion axis to bias the electrical contact into the socket with a force not exceeding a predetermined force.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a system and an apparatus for installing at least one electrical contact into a connector housing, according to one or more examples of the present disclosure;

FIG. 2 is a schematic perspective view of the apparatus of FIG. 1, according to one or more examples of the present disclosure;

FIG. 3 is a schematic side elevation view of the apparatus of FIG. 2, according to one or more examples of the present disclosure;

FIG. 4 is a schematic side elevation view of the apparatus of FIG. 2, according to one or more examples of the present disclosure;

FIG. 5 is a schematic side section view of the apparatus of FIG. 2, according to one or more examples of the present disclosure;

FIG. 6 is a schematic top plan view of the apparatus of FIG. 2, according to one or more examples of the present disclosure;

FIG. 7 is a block diagram of a method of installing an electrical contact into a socket of a connector housing, according to one or more examples of the present disclosure;

FIG. 8 is a block diagram of aircraft production and service methodology; and FIG. 9 is a schematic illustration of an aircraft.

DETAILED DESCRIPTION

Figure 1:
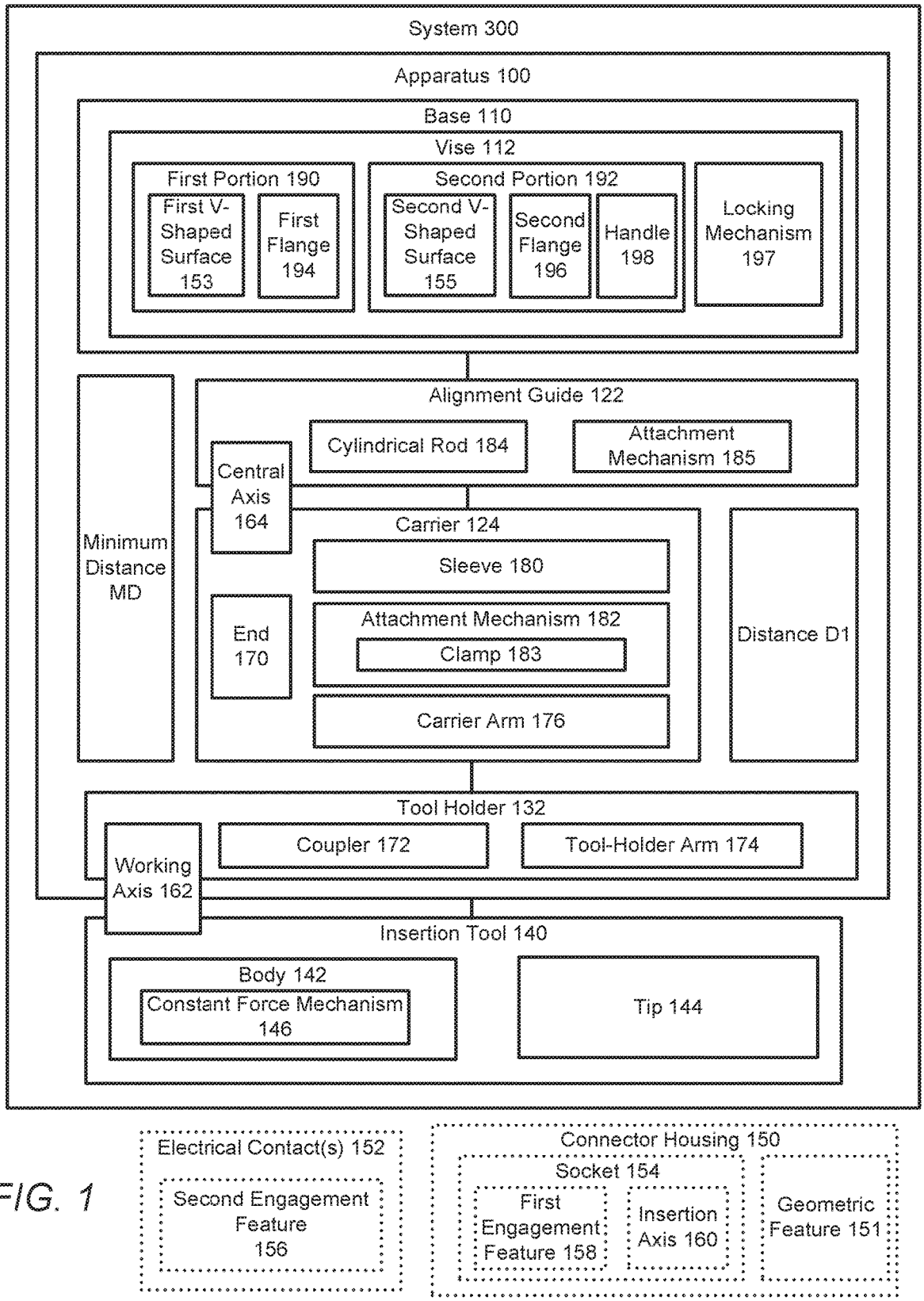
Figure 2:
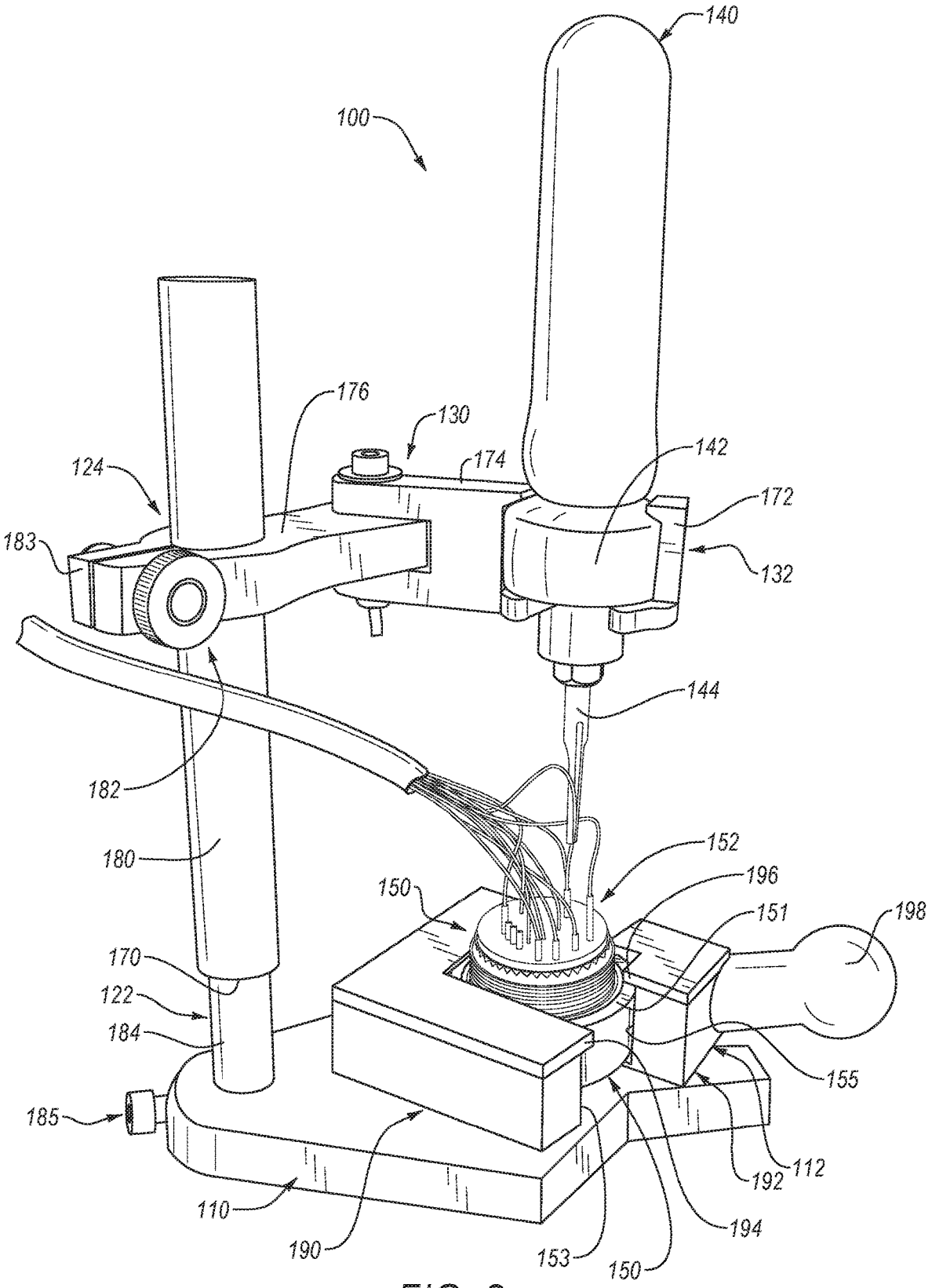
Figure 3:
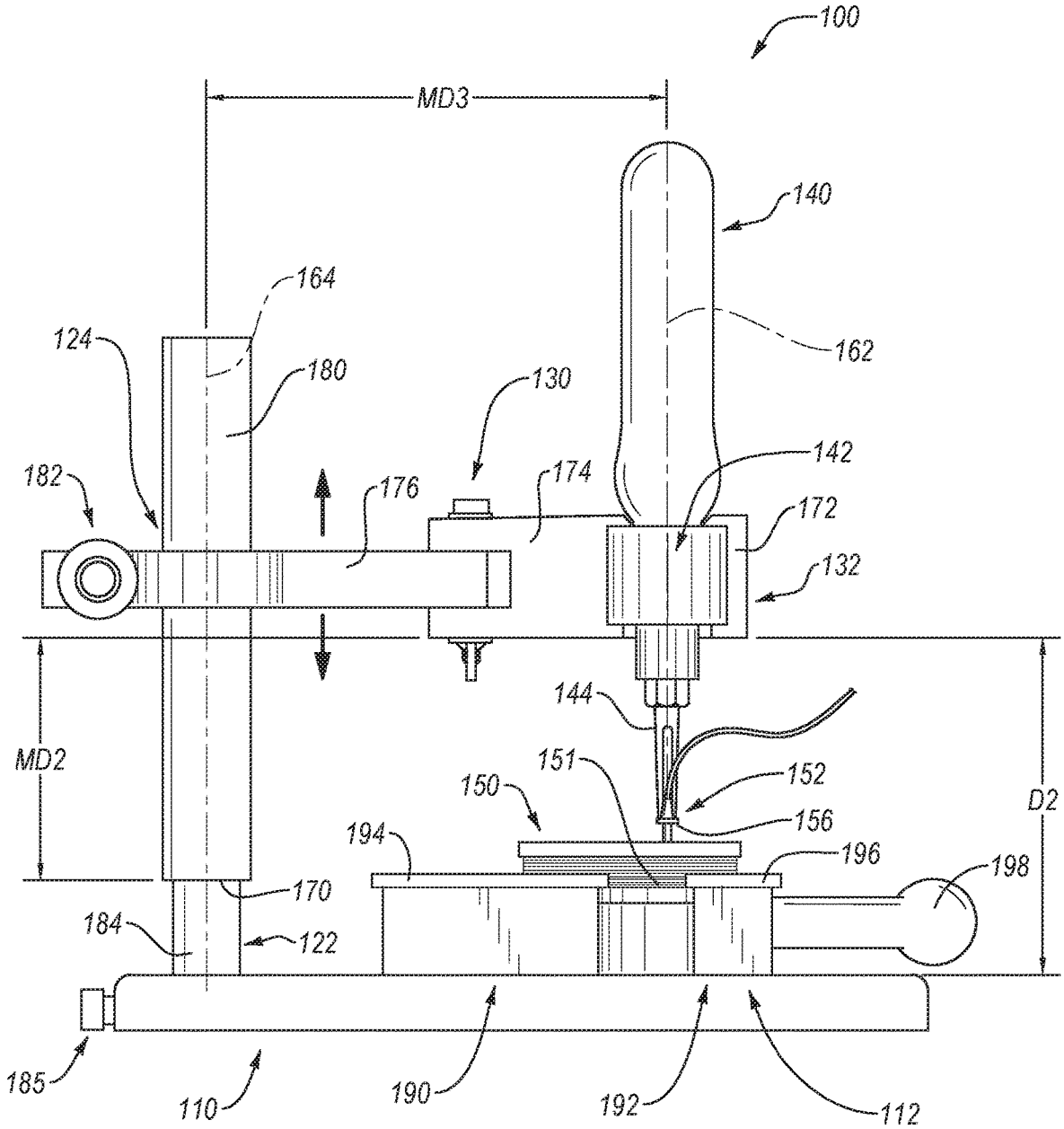

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 7:
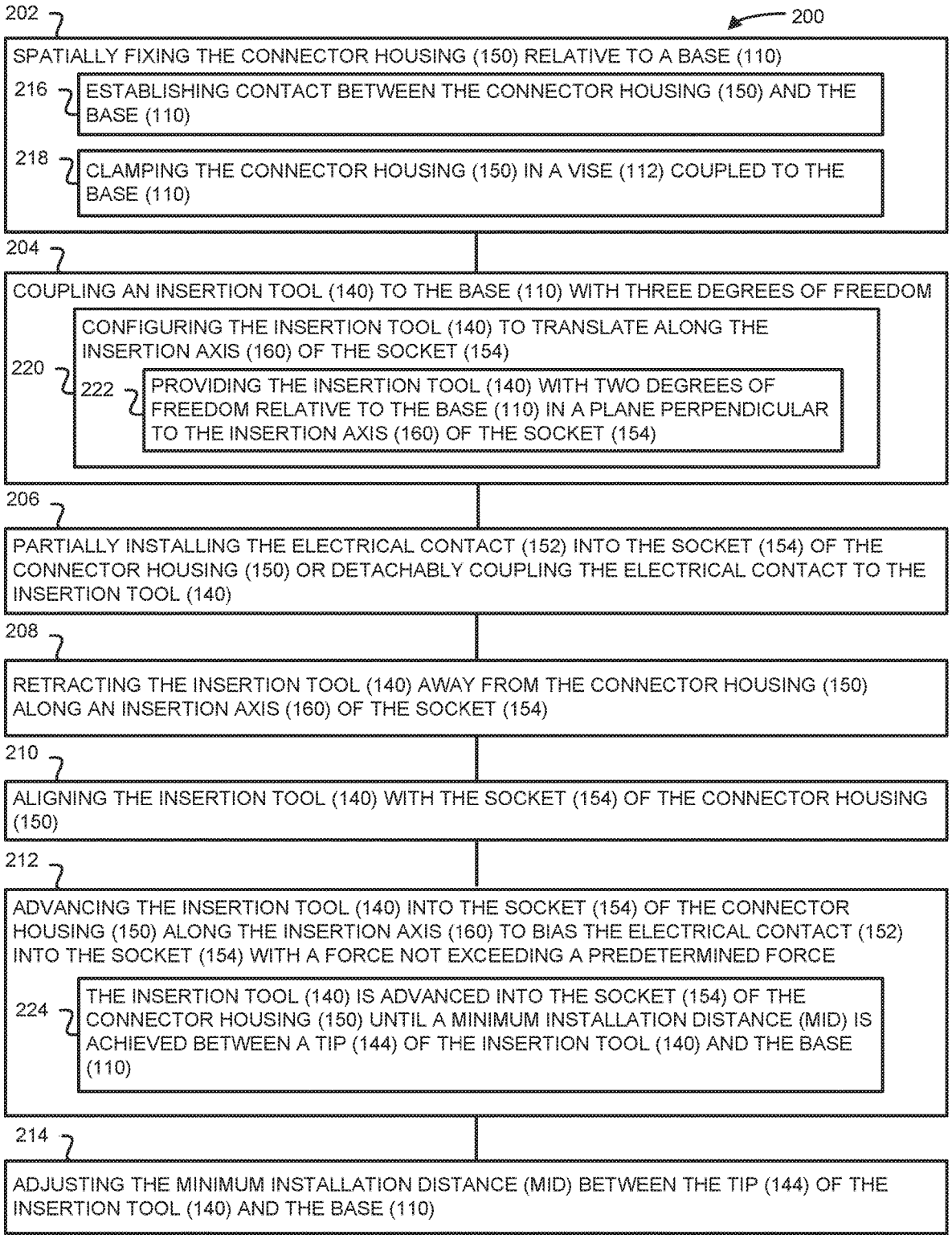
Figure 8:
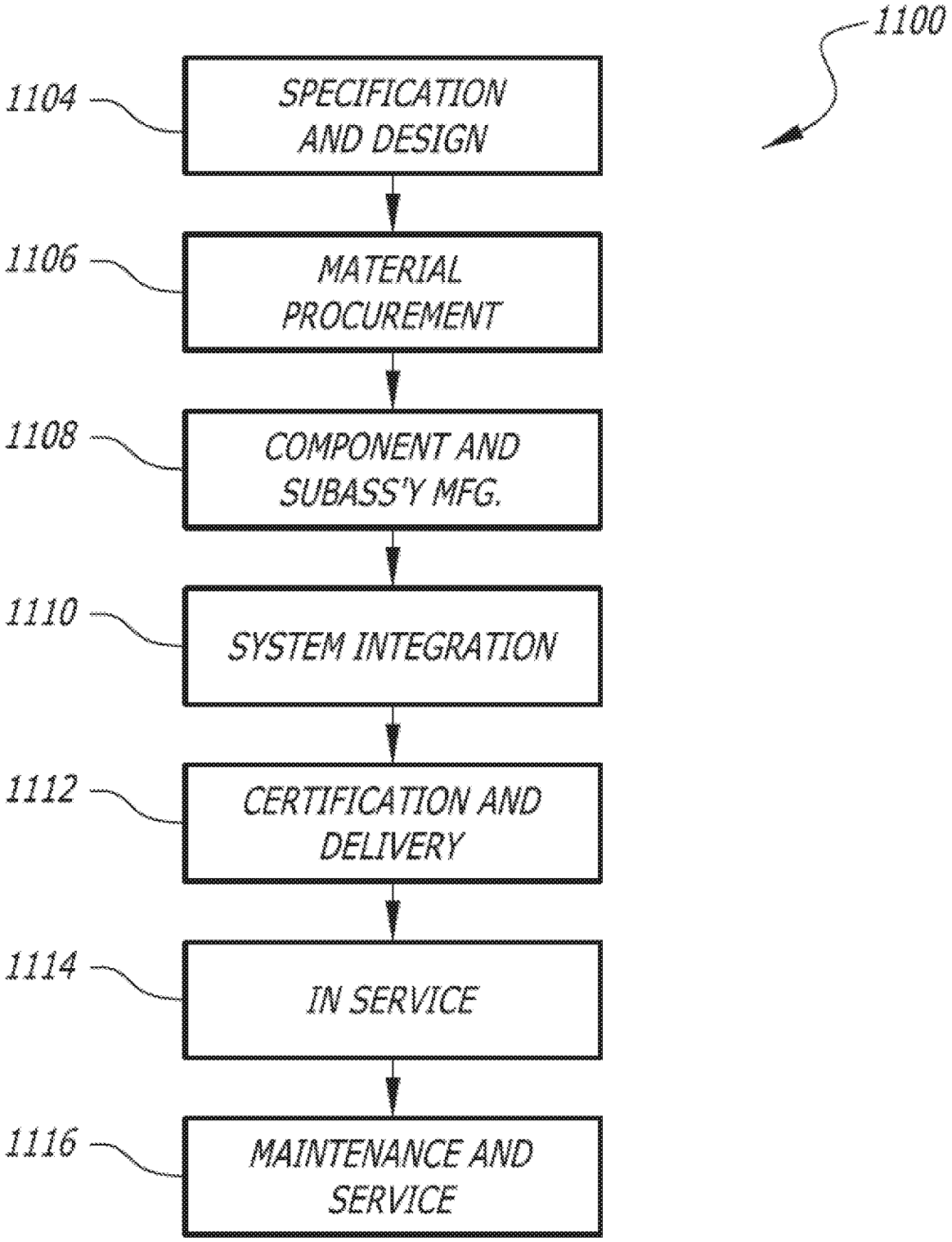

In FIG. 7, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 7 and 8 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, any means-plus-function clause is to be interpreted under 35 U.S.C. 112(f), unless otherwise explicitly stated. It should be noted that examples provided herein of any structure, material, or act in support of any means-plus-function clause, and equivalents thereof, may be utilized individually or in combination. Thus, while various structures, materials, or acts may be described in connection with a means-plus-function clause, any combination thereof or of their equivalents is contemplated in support of such means-plus-function clause.

Illustrative, non-exhaustive examples, which may or may not be claimed, of the subject matter according the present disclosure are provided below.

Referring, e.g., to FIGS. 1-6, apparatus 100 for installing at least one electrical contact 152 into connector housing 150 is disclosed. Apparatus 100 comprises base 110 configured to fixedly support connector housing 150. Additionally, apparatus 100 comprises alignment guide 122 extending from base 110 and having central axis 164. With connector housing 150 fixedly supported by base 110, alignment guide 122 is configured to be parallel to insertion axis 160 of socket 154 of connector housing 150. Apparatus 100 also comprises carrier 124 translatably and pivotally coupled with alignment guide 122. With connector housing 150 fixedly supported by base 110, carrier 124 is movable parallel to insertion axis 160 of socket 154 of connector housing 150. Apparatus 100 further comprises tool holder 132 coupled to carrier 124. Tool holder 132 has working axis 162, only one degree of freedom relative to carrier 124, and only three degrees of freedom relative to base 110. The preceding subject matter of this paragraph characterizes example 1 of the present disclosure.

Apparatus 100 is configured to ensure at least one electrical contact 152 is predictably installed into socket 154 of connector housing 150 along insertion axis 160 of socket 154. Installing at least one electrical contact 152 into socket 154 of connector housing 150 along insertion axis 160 of socket 154 ensures at least one electrical contact 152 does not bind within socket 154. Tool holder 132 having only three degrees of freedom relative to base 110 promotes control and predictability of the position of insertion tool 140 relative to socket 154 of connector housing 150 when installing at least one electrical contact 152 into socket 154. Socket 154 of connector housing 150 is a connector cavity of connector housing 150 that receives at least one electrical contact 152, which can be an electrical pin or electrical socket.

Figure 4:
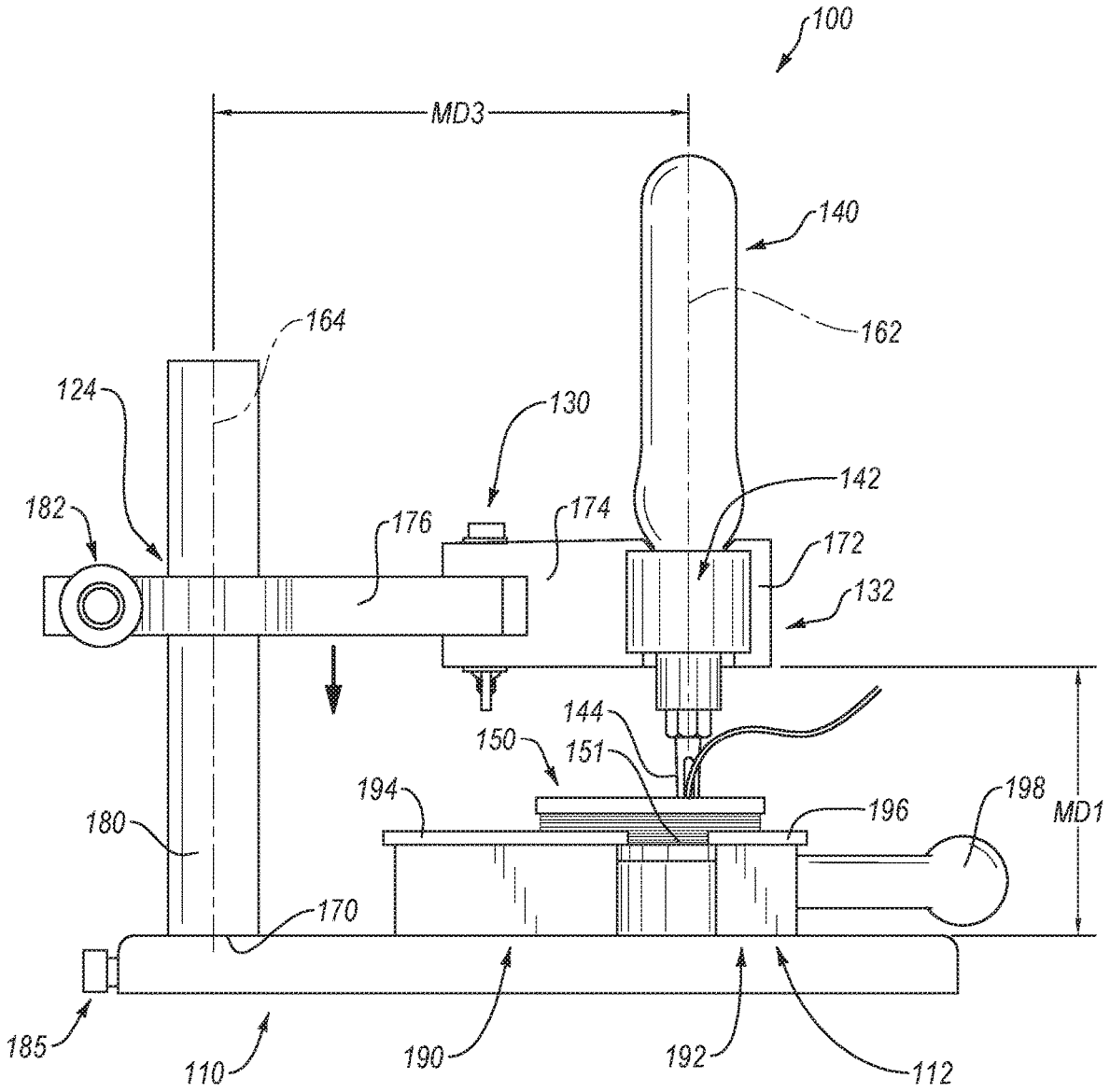
Figure 5:
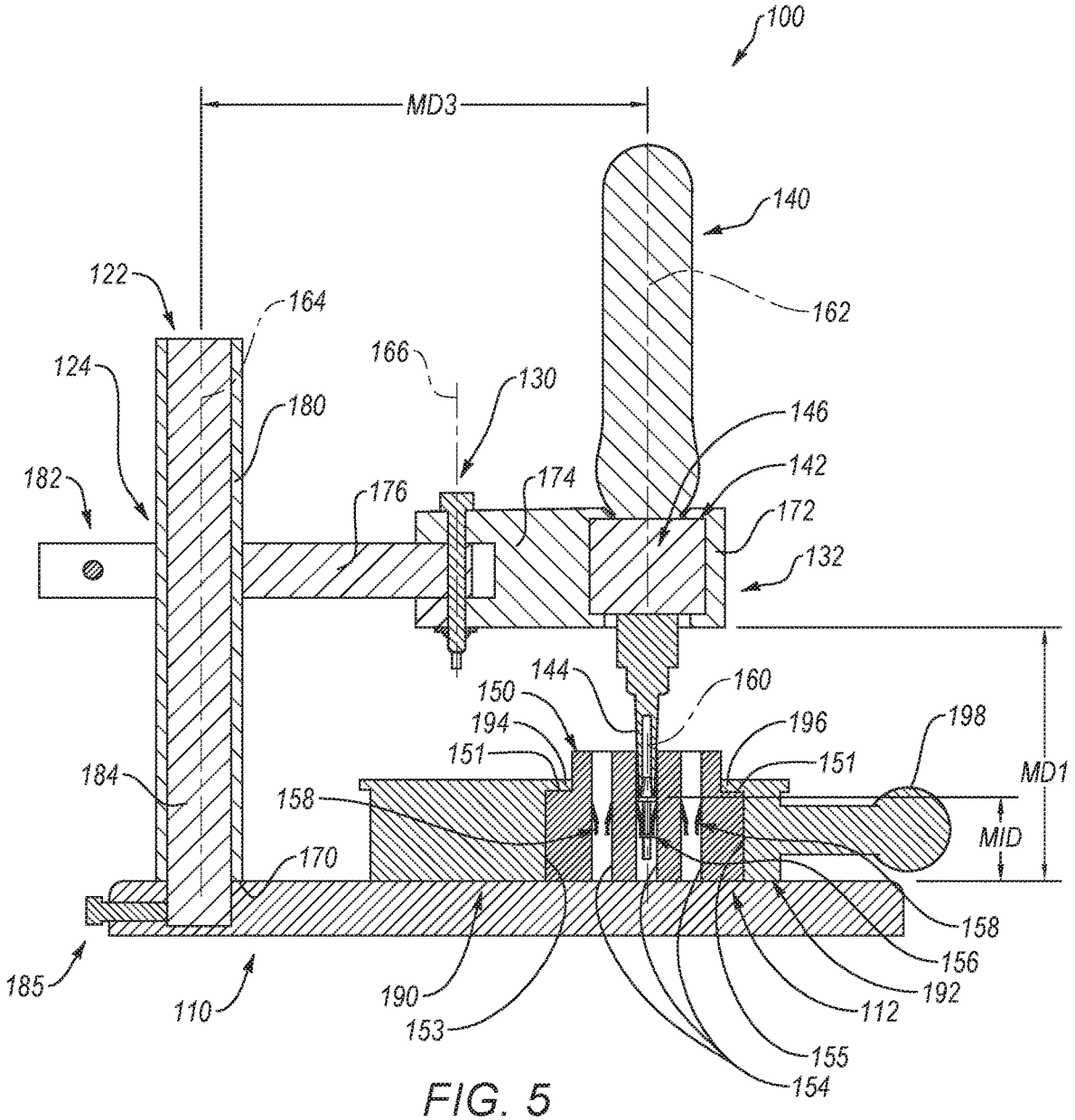

Referring generally to FIG. 1 and particularly to, e.g., FIG. 4, tool holder 132 is coupled to carrier 124 such that minimum distance MD1 is defined between tool holder 132 and base 110. The preceding subject matter of this paragraph characterizes example 2 of the present disclosure, wherein example 2 also includes the subject matter according to example 1, above.

Coupling tool holder 132 to carrier 124 to defining minimum distance MD1 between tool holder 132 and base 110 ensures tool holder 132 is not movable closer to base 110 than minimum distance MD1. By ensuring tool holder 132 does not move closer to base 110 than minimum distance MD1, over-insertion of at least one electrical contact 152 into socket 154 of connector housing 150 is prevented. Additionally, defining minimum distance MD1 between tool holder 132 and base 110 helps to ensure at least one electrical contact 152 is not under-inserted into socket 154 of connector housing 150.

Referring generally to FIG. 1 and particularly to, e.g., FIGS. 2-6, carrier 124 comprises sleeve 180 and carrier arm 176 that is configured to be fixed to sleeve 180 and is rotatably coupled with tool holder 132. The preceding subject matter of this paragraph characterizes example 3 of the present disclosure, wherein example 3 also includes the subject matter according to example 2, above.

Rotation of tool holder 132 relative to sleeve 180 of carrier 124 enables adjustment of the position of tool holder 132 relative to sleeve 180 and alignment guide 122, thereby enabling adjustment of the position of tool holder 132 relative to connector housing 150.

Referring generally to FIG. 1 and particularly to, e.g., FIGS. 2-6, carrier arm 176 is configured to be releasably fixed to sleeve 180. Carrier arm 176 is selectively repositionable relative to sleeve 180 along central axis 164 to adjust minimum distance MD1 between tool holder 132 and base 110. Central axis 164 is configured to be parallel to insertion axis 160 of socket 154. The preceding subject matter of this paragraph characterizes example 4 of the present disclosure, wherein example 4 also includes the subject matter according to example 3, above.

Selectively repositioning carrier arm 176 relative to sleeve 180 to adjust minimum distance MD1 between tool holder 132 and base 110 accommodates the installation of electrical contacts 152 of various configurations into sockets 154 of connector housings 150 of various configurations.

As defined herein, movement of a first feature along a second feature means movement of the first feature parallel to or concentric with the second feature.

Still referring generally to FIG. 1 and particularly to, e.g., FIGS. 2-6, carrier arm 176 is configured to be releasably fixed to sleeve 180 of carrier 124 via attachment mechanism 182. The preceding subject matter of this paragraph characterizes example 5 of the present disclosure, wherein example 5 also includes the subject matter according to example 4, above.

Attachment mechanism 182 enables convenient repositioning of carrier arm 176 relative to sleeve 180.

Continuing to refer generally to FIG. 1, and particularly to, e.g., FIGS. 2-6, attachment mechanism 182 comprises clamp 183. The preceding subject matter of this paragraph characterizes example 6 of the present disclosure, wherein example 6 also includes the subject matter according to example 5, above.

Clamp 183 provides quick loosening and tightening of carrier arm 176 to sleeve 180 and secure releasable fixation of carrier arm 176 to sleeve 180.

Referring generally to FIG. 1, minimum distance MD1 is fixed. The preceding subject matter of this paragraph characterizes example 7 of the present disclosure, wherein example 7 also includes the subject matter according to any one of examples 2 or 3, above.

Fixing minimum distance MD1 enables predictable compatibility of carrier 124 with a given electrical contact 152 and a given connector housing 150. For example, one carrier 124 can be configured with one fixed minimum distance MD1 that is compatible with a one configuration of electrical contacts 152 and connector housing 150 and another carrier 124 can be configured with another fixed minimum distance MD1 that is compatible with another configuration of electrical contacts 152 and connector housing 150. Differently configured carriers 124 may be selectively coupled with alignment guide 122 according to which carrier 124 has minimum distance MD1 that is compatible with the configuration of electrical contacts 152 and connector housing 150.

Referring generally to FIG. 1 and particularly to, e.g., FIGS. 2-6, minimum distance MD1 is adjustable. The preceding subject matter of this paragraph characterizes example 8 of the present disclosure, wherein example 8 also includes the subject matter according to any one of examples 2-6, above.

Adjustability of minimum distance MD1 between tool holder 132 and base 110 accommodates the installation of electrical contacts 152 of various configurations into sockets 154 of connector housings 150 of various configurations.

Referring generally to FIG. 1 and particularly to, e.g., FIGS. 2-6, carrier 124 comprises end 170. Minimum distance MD1 between tool holder 132 and base 110 is equal to minimum distance MD2 between tool holder 132 and end 170 of carrier 124. End 170 of carrier 124 is configured to contact base 110. The preceding subject matter of this paragraph characterizes example 9 of the present disclosure, wherein example 9 also includes the subject matter according to any one of examples 2-8, above.

Because minimum distance MD1 between tool holder 132 and base 110 is equal to minimum distance MD2 between tool holder 132 and end 170 of carrier 124, contact between end 170 of carrier 124 and base 110 ensures tool holder 132 is minimum distance MD1 from base 110.

Referring generally to FIG. 1 and particularly to, e.g., FIGS. 2-6, tool holder 132 comprises coupler 172 configured to removably retain insertion tool 140 in tool holder 132. The preceding subject matter of this paragraph characterizes example 10 of the present disclosure, wherein example 10 also includes the subject matter according to any one of examples 1-9, above.

Coupler 172 facilitates ease in retaining insertion tool 140 in tool holder 132 and removing insertion tool 140 from tool holder 132. For example, one insertion tool 140 can be quickly removed from tool holder 132 and replaced with another insertion tool 140. Insertion tool 140 can include body 142, which houses constant force mechanism 146. Constant force mechanism 146 ensures a constant force is applied to electrical contact 152 as insertion tool 140 installs electrical contact 152 into socket 154 of connector housing 150. Additionally, constant force mechanism 146 can ensure force applied to electrical contact 152 from insertion tool 140 does not exceed a threshold force. In one example, insertion tool 140 is an RFX connector insertion tool manufactured by Russtech® of Irvine, Calif. Coupler 172 may also facilitate rotation of insertion tool 140 relative to tool holder 132 while removably retaining tool 140 in tool holder 132.

Referring generally to FIG. 1 and particularly to, e.g., FIGS. 2-6, coupler 172 of tool holder 132 is configured to removably retain insertion tool 140 with a snap fit. The preceding subject matter of this paragraph characterizes example 11 of the present disclosure, wherein example 11 also includes the subject matter according to example 10, above.

Removable retention of insertion tool 140 with a snap fit enables secure retention of insertion tool 140 while at least one electrical contact 152 is installed into connector housing 150. The snap fit may also provide audible or tactile feedback that insertion tool 140 is properly retained by tool holder 132. Further, in one example, coupler 172 is resiliently flexible to enable removable retention of insertion tool 140 by tool holder 132 with a snap fit.

Referring generally to FIG. 1 and particularly to, e.g., FIGS. 2-6, coupler 172 of tool holder 132 is configured to removably retain insertion tool 140 with an interference fit. The preceding subject matter of this paragraph characterizes example 12 of the present disclosure, wherein example 12 also includes the subject matter according to example 10, above.

Removable retention of insertion tool 140 with an interference fit enables secure retention of insertion tool 140 while at least one electrical contact 152 is installed into connector housing 150.

Referring generally to FIG. 1 and particularly to, e.g., FIGS. 2-6, coupler 172 of tool holder 132 is configured to interlock with insertion tool 140 to prevent insertion tool 140 from moving relative to coupler 172 along insertion axis 160 of socket 154. The preceding subject matter of this paragraph characterizes example 13 of the present disclosure, wherein example 13 also includes the subject matter according to example 10, above.

Interlocking of coupler 172 with insertion tool 140 enables secure retention of insertion tool 140 while at least one electrical contact 152 is installed into connector housing 150. In one example, coupler 172 includes a stop that engages body 142 of insertion tool 140 to prevent insertion tool 140 from moving relative to coupler 172 along insertion axis 160 of socket 154 toward base 110. Additionally, coupler 172 includes at least one tab that engages body 142 of insertion tool 140 to prevent insertion tool 140 from moving relative to coupler 172 along insertion axis 160 of socket 154 away from base 110. Engagement of both the stop and at least one tab of coupler 172 with body 142 of insertion tool 140 interlocks insertion tool 140 between the stop and at least one tab of coupler 172. The at least one tab of coupler 172 may be resiliently flexible to engage (e.g., interlock) and disengage (e.g., unlock) body 142 of insertion tool 140.

Referring generally to FIG. 1 and particularly to, e.g., FIGS. 3-6, central axis 164 of alignment guide 122 is configured to be parallel to insertion axis 160 of socket 154. Tool holder 132 is coupled to carrier 124 such that working axis 162 of tool holder 132 is parallel to central axis 164 of alignment guide 122. The preceding subject matter of this paragraph characterizes example 14 of the present disclosure, wherein example 14 also includes the subject matter according to any one of examples 1-13, above.

Coupling tool holder 132 to carrier 124 such that working axis 162 of tool holder 132 is parallel to central axis 164 of alignment guide 122 ensures working axis 162 of tool holder 132 is parallel to insertion axis 160 of socket 154. With working axis 162 of tool holder 132 parallel to insertion axis 160 of socket 154, and insertion tool 140 removably retained by tool holder 132, proper alignment of insertion tool 140 relative to insertion axis 160 of socket 154 is ensured for installing at least one electrical contact 152 into socket 154 of connector housing 150.

Referring generally to FIG. 1 and particularly to, e.g., FIGS. 3-6, minimum distance MD3 between central axis 164 of alignment guide 122 and working axis 162 of tool holder 132 is adjustable. The preceding subject matter of this paragraph characterizes example 15 of the present disclosure, wherein example 15 also includes the subject matter according to 14, above.

Adjustability of minimum distance MD3 between central axis 164 of alignment guide 122 and working axis 162 of tool holder 132 enables installation of at least one electrical contact 152 into any of various sockets 154 of connector housing 150. Connector housing 150 has multiple sockets 154 according to one example. With insertion tool 140 coupled to tool holder 132, minimum distance MD3 can be adjusted to align insertion tool 140 with any of multiple sockets 154 of connector housing 150. In some examples, after installing one electrical contact 152 into one socket 154 of connector housing 150, minimum distance MD3 is adjusted to install another electrical contact 152 into another socket 154 of connector housing.

Referring generally to FIG. 1 and particularly to, e.g., FIGS. 3-6, tool holder 132 comprises tool-holder arm 174 and carrier 124 comprises carrier arm 176 pivotally coupled with tool-holder arm 174. Minimum distance MD3 between central axis 164 of alignment guide 122 and working axis 162 of tool holder 132 is adjustable by pivoting tool-holder arm 174 relative to carrier arm 176. The preceding subject matter of this paragraph characterizes example 16 of the present disclosure, wherein example 16 also includes the subject matter according to example 15, above.

Pivoting tool-holder arm 174 relative to carrier arm 176 to adjust minimum distance MD3 between central axis 164 of alignment guide and working axis 162 of tool holder 132 facilitates ease in adjusting minimum distance MD3. Moreover, in one example, adjustment of minimum distance MD3 can be accomplished by pivoting tool-holder arm 174 relative to carrier arm 176 with carrier arm 176 fixed relative to alignment guide 122.

Referring generally to FIG. 1 and particularly to, e.g., FIGS. 3-6, minimum distance MD3 between central axis 164 of alignment guide 122 and working axis 162 of tool holder 132 is adjustable by pivoting carrier 124 relative to alignment guide 122. The preceding subject matter of this paragraph characterizes example 17 of the present disclosure, wherein example 17 also includes the subject matter according to example 16, above.

Pivoting carrier 124 relative to alignment guide 122 to adjust minimum distance MD3 between central axis 164 of alignment guide and working axis 162 of tool holder 132 facilitates ease in adjusting minimum distance MD3. Moreover, in one example, adjustment of minimum distance MD3 can be accomplished by pivoting carrier 124 relative to alignment guide 122 with tool-holder arm 174 fixed relative to carrier arm 176.

Referring generally to FIG. 1 and particularly to, e.g., FIGS. 2, 3, 5, and 6, alignment guide 122 comprises cylindrical rod 184. The preceding subject matter of this paragraph characterizes example 18 of the present disclosure, wherein example 18 also includes the subject matter according to any one of examples 1-17, above.

Cylindrical rod 184 of alignment guide 122 facilitates rotatability of carrier 124 relative to alignment guide.

Referring generally to FIG. 1 and particularly to, e.g., FIGS. 2-6, carrier 124 comprises sleeve 180 that is configured to receive cylindrical rod 184 of alignment guide 122. Additionally, sleeve 180 is configured to translate along cylindrical rod 184 in a direction parallel to insertion axis 160. Further, sleeve 180 is configured to rotate about cylindrical rod 184. The preceding subject matter of this paragraph characterizes example 19 of the present disclosure, wherein example 19 also includes the subject matter according to example 18, above.

Translation of sleeve 180 along cylindrical rod 184 in direction parallel to insertion axis 160 enables advancing of insertion tool 140 into socket 154 of connector housing 150 and withdrawal of insertion tool 140 from socket 154 of connector housing 150. The configuration of sleeve 180 and cylindrical rod 184 facilitates ease of translational motion between sleeve 180 and cylindrical rod 184. For example, sleeve 180 may include an internal channel with a diameter slightly larger than a diameter of cylindrical rod 184 such that a central axis of sleeve 180 may be slightly misaligned with central axis 164. Due to the larger diameter of the internal channel of sleeve 180 relative to the diameter of cylindrical rod 184, ease of translational motion between sleeve 180 and cylindrical rod 184 is promoted. Because of the length of sleeve 180 and cylindrical rod 184, slight misalignment between central axis of sleeve 180 and central axis 164 does not cause binding between sleeve 180 and cylindrical rod 184. Linear bearings may alternatively be used between sleeve 180 and cylindrical rod 184 to facilitate ease of translational motion between sleeve 180 and cylindrical rod 184. Rotation of sleeve 180 about cylindrical rod 184 facilitates adjustment of minimum distance MD3 and repositioning of insertion tool 140 relative to connector housing 150.

Referring generally to FIG. 1 and particularly to, e.g., FIGS. 2-6, alignment guide 122 is removably coupled to base 110. The preceding subject matter of this paragraph characterizes example 20 of the present disclosure, wherein example 20 also includes the subject matter according to any one of examples 1-19, above.

Removable coupling of alignment guide 122 to base 110 enables convenient removal of alignment guide 122 from base 110 and coupling of alignment guide 122 to base 110. In one example, one alignment guide 122, which may be coupled to carrier 124 and tool holder 132 with a first configuration, can be removed from base 110 and replaced with another alignment guide 122, which may be coupled to carrier 124 and tool holder 132 with a second configuration that is different than the first configuration. Alignment guide 122 can be removably coupled to base 110 via attachment mechanism 185. Attachment mechanism 185 can include a set screw coupled to base 110 that engages alignment guide 122 to removably couple alignment guide 122 to base 110.

Referring generally to FIG. 1 and particularly to, e.g., FIGS. 2-6, the apparatus further comprises vise 112 coupled to base 110 and configured to fixedly retain connector housing 150 relative to base 110. The preceding subject matter of this paragraph characterizes example 21 of the present disclosure, wherein example 21 also includes the subject matter according to any one of examples 1-20, above.

Vise 112 fixedly retains connector housing 150 relative to base 110 to securely and predictably position connector housing 150 relative to alignment guide 122 and carrier 124.

Referring generally to FIG. 1 and particularly to, e.g., FIGS. 2-6, vise 112 comprises first portion 190 and second portion 192. First portion 190 is stationary relative to base 110. Second portion 192 is movable relative to first portion 190 The preceding subject matter of this paragraph characterizes example 22 of the present disclosure, wherein example 22 also includes the subject matter according to example 21, above.

Second portion 192 of vise 112 is movable relative to first portion 190 of vise 112 to fixedly retain connector housing 150 relative to base 110. Second portion 192 of vise 112 can be movable toward first portion 190 of vise 112 to fixedly retain connector housing 150 relative to base 110 and movable away from first portion 190 of vise 112 to release connector housing 150 from base 110.

Referring generally to FIG. 1 and particularly to, e.g., FIGS. 2-6, first portion 190 of vise 112 comprises flange 194 configured to engage geometric feature 151 of connector housing 150. Second portion 192 of vise 112 comprises flange 196 configured to engage geometric feature 151 of connector housing 150. The preceding subject matter of this paragraph characterizes example 23 of the present disclosure, wherein example 23 also includes the subject matter according to example 22, above.

Engagement of geometric feature 151 of connector housing 150 by flange 194 of first portion 190 of vise 112 and engagement of geometric feature 151 of connector housing 150 by flange 196 of second portion 192 of vise 112 prevents connector housing 150 from movement of connector housing 150 relative to base 110 in direction parallel to insertion axis 160.

Referring generally to FIG. 1 and particularly to, e.g., FIGS. 2-6, first portion 190 of vise 112 comprises first V-shaped surface 153 configured to engage two discrete regions of connector housing 150. Second portion 192 of vise 112 comprises second V-shaped surface 155 configured to engage two discrete regions of connector housing 150. The preceding subject matter of this paragraph characterizes example 24 of the present disclosure, wherein example 24 also includes the subject matter according to any one of examples 22 or 23, above.

First V-shaped surface 153 of first portion 190 of vise 112 and second V-shaped surface 155 of second portion 192 of vise 112 each engages two discrete regions of connector housing 150 to enable fixed retention of connector housings 150 of various shapes and sizes relative to base 110.

Still referring generally to FIG. 1 and particularly to, e.g., FIGS. 2-6, second portion 192 of vise 112 comprises handle 198 fixed relative to second portion 192. The preceding subject matter of this paragraph characterizes example 25 of the present disclosure, wherein example 25 also includes the subject matter according to any one of examples 22-24, above.

Handle 198 of second portion 192 of vise 112 facilitates movement of second portion 192 relative to first portion 190. In one example, handle 198 is configured to be easily grippable by a user.

Figure 6:
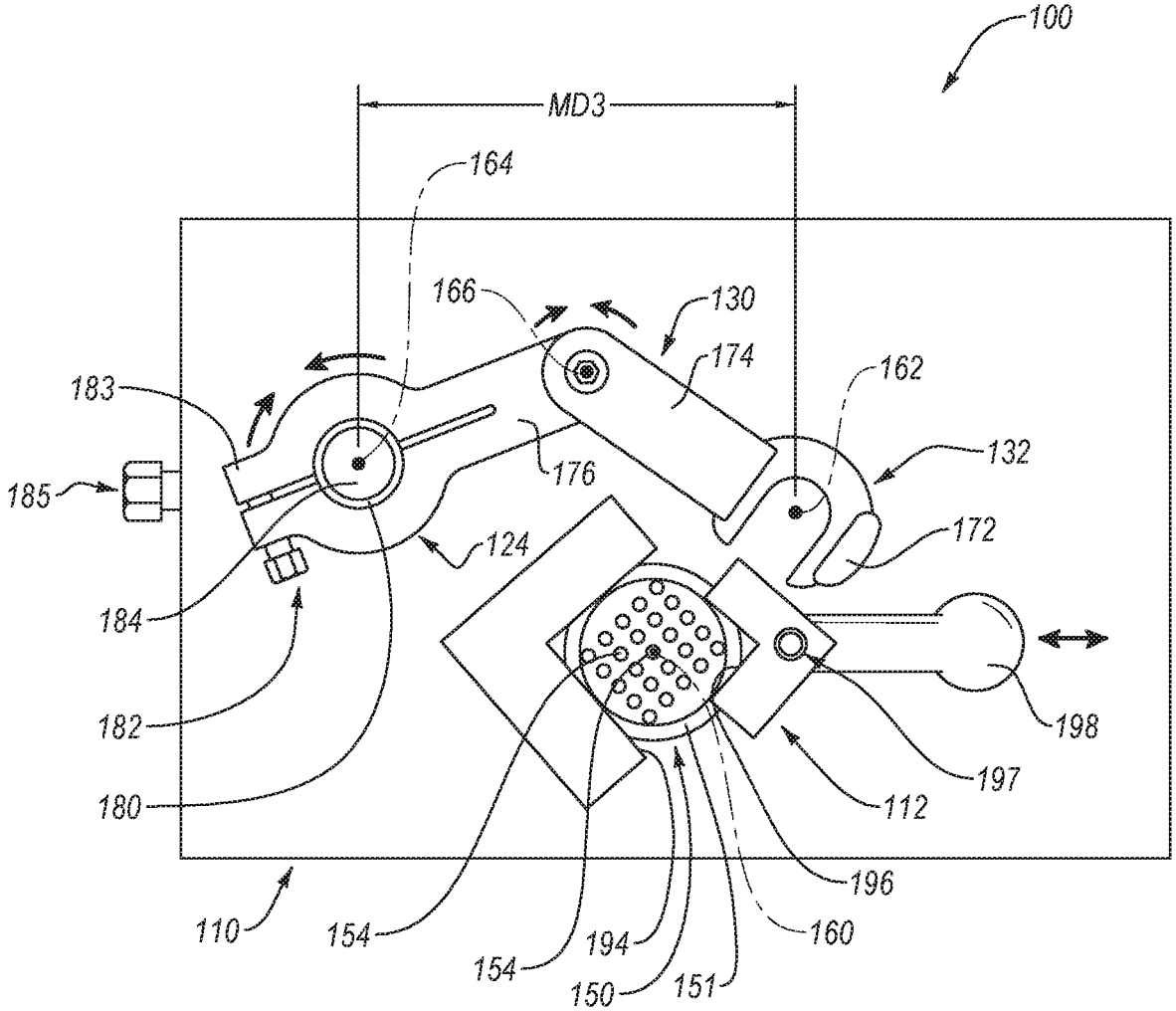

Referring generally to FIG. 1 and particularly to, e.g., FIG. 6, vise 112 further comprises locking mechanism 197 configured to releasably lock second portion 192 of vise 112 to base 110. The preceding subject matter of this paragraph characterizes example 26 of the present disclosure, wherein example 26 also includes the subject matter according to any one of examples 22-25, above.

With connector housing 150 between first portion 190 and second portion 192 of vise 112, locking mechanism 197 releasably locks second portion 192 of vise 112 to base 110 to fixedly retain connector housing 150 relative to base 110. Locking mechanism 197 can include a set screw that extends through second portion 192 of vise 112 and engages base 110 to releasably lock second portion 192 of vise 112 to base 110.

Referring, e.g., to FIGS. 1-6, system 300 for installing at least one electrical contact 152 into connector housing 150 is disclosed. System 300 comprises base 110 configured to fixedly support connector housing 150. Additionally, system 300 comprises alignment guide 122 extending from base 110 and having central axis 164. With connector housing 150 fixedly supported by base 110, alignment guide 122 is configured to be parallel to insertion axis 160 of socket 154 of connector housing 150. System 300 also comprises carrier 124 translatably and pivotally coupled with alignment guide 122. With connector housing 150 fixedly supported by base 110, carrier 124 is movable parallel to insertion axis 160 of socket 154 of connector housing 150. System 300 further comprises tool holder 132 coupled to carrier 124. Tool holder 132 has working axis 162, only one degree of freedom relative to carrier 124, and only three degrees of freedom relative to base 110. System 300 also comprises insertion tool 140 coupled to tool holder 132. The preceding subject matter of this paragraph characterizes example 27 of the present disclosure.

System 300 is configured to ensure at least one electrical contact 152 is predictably installed into socket 154 of connector housing 150 along insertion axis 160 of socket 154. Installing at least one electrical contact 152 into socket 154 of connector housing 150 along insertion axis 160 of socket 154 ensures at least one electrical contact 152 does not bind within socket 154. Tool holder 132 having only three degrees of freedom relative to base 110 promotes control and predictability of the position of insertion tool 140 relative to socket 154 of connector housing 150 when installing at least one electrical contact 152 into socket 154.

Referring generally to FIGS. 1-6, and particularly to, e.g., FIG. 7 (blocks 202-212), method 200 of installing electrical contact 152 into socket 154 of connector housing 150, is disclosed. Method 200 comprises spatially fixing connector housing 150 relative to base 110. Additionally, method 200 comprises coupling insertion tool 140 to base 110 with three degrees of freedom. Method 200 also comprises partially installing electrical contact 152 into socket 154 of connector housing 150 or detachably coupling electrical contact 152 to insertion tool 140. Further, method 200 comprises retracting insertion tool 140 away from connector housing 150 along insertion axis 160 of socket 154. Method 200 additionally comprises aligning insertion tool 140 with socket 154 of connector housing 150. Also, method 200 comprises advancing insertion tool 140 into socket 154 of connector housing 150 along insertion axis 160 to bias electrical contact 152 into socket 154 with a force not exceeding a predetermined force. The preceding subject matter of this paragraph characterizes example 28 of the present disclosure.

Method 200 improves the ease and accuracy of installing electrical contact 152 into socket 154 of connector housing 150 along insertion axis 160 of socket 154. Installing electrical contact 152 into socket 154 of connector housing 150 along insertion axis 160 of socket 154 ensures electrical contact 152 does not bind within socket 154. Advancing insertion tool 140 into socket 154 with a force not exceeding a predetermined force ensures electrical contact 152 is not inserted beyond a desirable position within socket 154. The desirable position can be the position at which second engagement feature 156 of electrical contact 152 engages first engagement feature 158 of socket 154. Insertion tool 140 having only three degrees of freedom relative to base 110 promotes control and predictability of the position of insertion tool 140 relative to socket 154 of connector housing 150 when installing electrical contact 152 into socket 154 of connector housing 150.

Continuing to refer generally to FIGS. 1-6 and particularly to, e.g., FIG. 7 (block 216), spatially fixing connector housing 150 relative to base 110 comprises establishing contact between connector housing 150 and base 110. The preceding subject matter of this paragraph characterizes example 29 of the present disclosure, wherein example 29 also includes the subject matter according to example 28, above.

Establishing contact between connector housing 150 and base 110 helps to ensure that connector housing 150 is fixedly positioned in a known location relative to base 110, and thus insertion tool 100.

Continuing to refer generally to FIGS. 1-6 and particularly to, e.g., FIG. 7 (block 218), spatially fixing connector housing 150 relative to base 110 comprises clamping connector housing 150 in vise 112 coupled to base 110. The preceding subject matter of this paragraph characterizes example 30 of the present disclosure, wherein example 30 also includes the subject matter according to any one of examples 28 or 29, above.

Clamping connector housing 150 in vise 112 coupled to base 110 ensures that connector housing 150 is fixedly positioned in a known location relative to base 110, and thus insertion tool 100. Vise 112 fixedly retains connector housing 150 relative to base 110 to securely and predictably position connector housing 150 relative to base 110 and insertion tool 100.

Continuing to refer generally to FIGS. 1-6 and particularly to, e.g., FIG. 7 (block 224), insertion tool 140 is advanced into socket 154 of connector housing 150 until minimum installation distance MID is achieved between tip 144 of insertion tool 140 and base 110. The preceding subject matter of this paragraph characterizes example 31 of the present disclosure, wherein example 31 also includes the subject matter according to any one of examples 28-30, above.

Advancing insertion tool 140 into socket 154 of connector housing 150 until minimum installation distance MID is achieved between tip 144 of insertion tool 140 and base 110 ensures tip 144 of insertion tool 140 is not movable closer to base 110 than minimum installation distance MID. By ensuring tip 144 of insertion tool 140 does not move closer to base 110 than minimum installation distance MID, over-insertion of electrical contact 152 into socket 154 of connector housing 150 is prevented. Additionally, achieving minimum installation distance MID helps to ensure electrical contact 152 is not under-inserted into socket 154 of connector housing 150.

Continuing to refer generally to FIGS. 1-6 and particularly to, e.g., FIG. 7 (block 214), method 200 further comprises adjusting minimum installation distance MID between tip 144 of insertion tool 140 and base 110. The preceding subject matter of this paragraph characterizes example 32 of the present disclosure, wherein example 32 also includes the subject matter according to example 31, above.

Adjustability of minimum installation distance MID between tip 144 of insertion tool 140 and base 110 accommodates the installation of electrical contacts 152 of various configurations into sockets 154 of connector housings 150 of various configurations.

Continuing to refer generally to FIGS. 1-6 and particularly to, e.g., FIG. 7 (block 220), coupling insertion tool 140 to base 110 with three degrees of freedom comprises configuring insertion tool 140 to translate along insertion axis 160 of socket 154. The preceding subject matter of this paragraph characterizes example 33 of the present disclosure, wherein example 33 also includes the subject matter according to any one of examples 28-32, above.

Configuring insertion tool 140 to translate along insertion axis 160 of socket 154 ensures electrical contact 152 does not bind within socket 154 as electrical contact 152 is biased into socket 154 by insertion tool 140.

Continuing to refer generally to FIGS. 16 and particularly to, e.g., FIG. 7 (block 222), coupling insertion tool 140 to base 110 with three degrees of freedom comprises providing insertion tool 140 with two degrees of freedom relative to base 110 in a plane perpendicular to insertion axis 160 of socket 154. The preceding subject matter of this paragraph characterizes example 34 of the present disclosure, wherein example 34 also includes the subject matter according to example 33, above.

Two degrees of freedom relative to base 110 in a plane perpendicular to insertion axis 160 of socket 154 allows insertion tool 140 to be positioned relative to connector housing 150 in any position along the plane perpendicular to insertion axis 160. Such flexibility in the position of insertion tool 140 relative to connector housing 150 facilitates the installation of electrical contact 152 into any one of multiple sockets 154 in any of various locations in connector housing 150.

Figure 9:
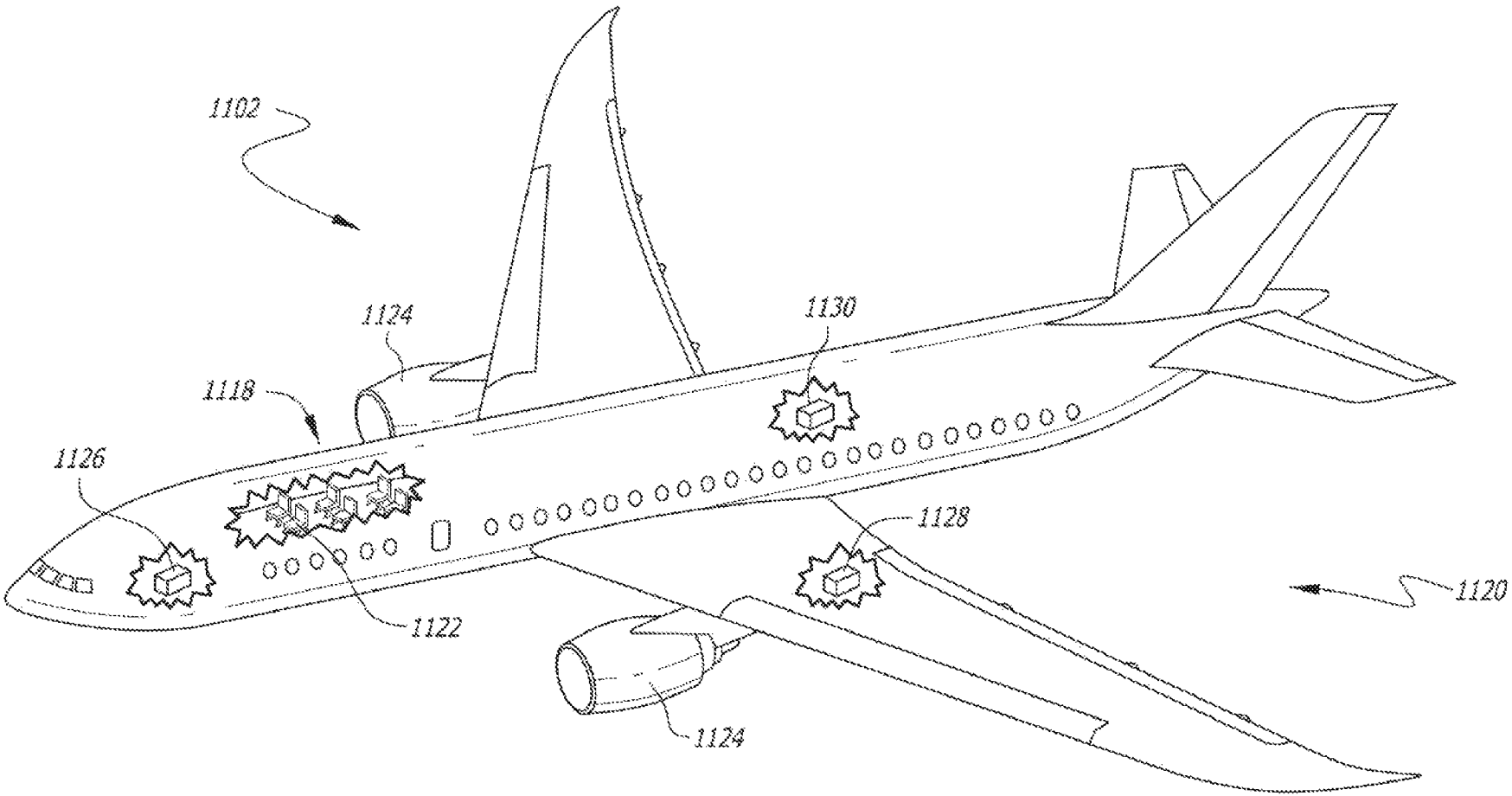

Examples of the present disclosure may be described in the context of aircraft manufacturing and service method 1100 as shown in FIG. 8 and aircraft 1102 as shown in FIG. 9. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG.9, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of installing an electrical contact into a socket of a connector housing, the method comprising steps of:

spatially fixing the connector housing relative to a base;

coupling an insertion tool to the base with three degrees of freedom;

partially installing the electrical contact into the socket of the connector housing or detachably coupling the electrical contact to the insertion tool;

aligning the insertion tool with the socket of the connector housing; and advancing the insertion tool into the socket of the connector housing along an insertion axis to bias the electrical contact into the socket with a force not exceeding a predetermined force, wherein the step of coupling the insertion tool to the base with the three degrees of freedom comprises coupling the insertion tool with a tool holder, rotatably coupling the tool holder with a carrier, and translatably and pivotally coupling the carrier with the base.

2. The method according to claim 1, wherein the step of spatially fixing the connector housing relative to the base comprises establishing contact between the connector housing and the base.

3. The method according to claim 1, wherein the step of spatially fixing the connector housing relative to the base comprises clamping the connector housing in a vise coupled to the base.

4. The method according to claim 1, wherein the insertion tool is advanced into the socket of the connector housing until a minimum installation distance is achieved between a tip of the insertion tool and the base.

5. The method according to claim 4, further comprising a step of adjusting the minimum installation distance between the tip of the insertion tool and the base.

6. The method according to claim 1, wherein the step of coupling the insertion tool to the base with the three degrees of freedom further comprises configuring the insertion tool to translate along the insertion axis of the socket.

7. The method according to claim 6, wherein the step of coupling the insertion tool to the base with the three degrees of freedom further comprises providing the insertion tool with two degrees of freedom relative to the base in a plane perpendicular to the insertion axis of the socket.

8. The method according to claim 1, wherein the step of advancing the insertion tool into the socket of the connector housing along the insertion axis to bias the electrical contact into the socket with the force not exceeding the predetermined force comprises inserting the electrical contact into the socket no farther than a predetermined position within the socket.

9. The method according to claim 8, wherein the predetermined position within the socket is a position at which a second engagement feature of the electrical contact is engaged with a first engagement feature of the socket.

10. The method according to claim 2, wherein the step of spatially fixing the connector housing relative to the base comprises clamping the connector housing in a vise, coupled to the base.

11. The method according to claim 2, wherein the insertion tool is advanced into the socket of the connector housing until a minimum installation distance is achieved between a tip of the insertion tool and the base.

12. The method according to claim 3, wherein the insertion tool is advanced into the socket of the connector housing until a minimum installation distance is achieved between a tip of the insertion tool and the base.

13. The method according to claim 2, wherein the step of coupling the insertion tool to the base with the three degrees of freedom further comprises configuring the insertion tool to translate along the insertion axis of the socket.

14. The method according to claim 3, wherein the step of coupling the insertion tool to the base with the three degrees of freedom further comprises configuring the insertion tool to translate along the insertion axis of the socket.

15. The method according to claim 4, wherein the step of coupling the insertion tool to the base with the three degrees of freedom comprises configuring the insertion tool to translate along the insertion axis of the socket.

16. The method according to claim 5, wherein the step of coupling the insertion tool to the base with the three degrees of freedom comprises further configuring the insertion tool to translate along the insertion axis of the socket.

17. The method according to claim 4, wherein the step of translatably and pivotally coupling the carrier with the base comprises translatably and pivotally coupling a sleeve of the carrier to an alignment guide, extending from the base.

18. The method according to claim 17, wherein the step of adjusting the minimum installation distance between the tip of the insertion tool and the base comprises selectively repositioning a carrier arm of the carrier relative to the sleeve along a central axis of the alignment guide.

19. The method according to claim 1, wherein the step of spatially fixing the connector housing relative to the base comprises fixedly retaining the connector housing relative to the base with a vise.

20. The method according to claim 17, wherein the step of spatially fixing the connector housing relative to the base comprises fixedly retaining the connector housing relative to the base with a vise.

* * * * *